US008550666B2

(12) United States Patent
Kim

(10) Patent No.: US 8,550,666 B2
(45) Date of Patent: Oct. 8, 2013

(54) LIGHTING APPARATUS

(75) Inventor: Jongpil Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 28 days.

(21) Appl. No.: 13/422,231

(22) Filed: Mar. 16, 2012

(65) Prior Publication Data

US 2013/0094212 A1 Apr. 18, 2013

(30) Foreign Application Priority Data

Oct. 18, 2011 (KR) ..... 10-2011-0106311

(51) Int. Cl.
*F21S 4/00* (2006.01)

(52) U.S. Cl.
USPC ..... 362/294

(58) Field of Classification Search
USPC ..... 362/249.02, 249.05
See application file for complete search history.

(56) References Cited

U.S. PATENT DOCUMENTS

| | | | | |
|---|---|---|---|---|
| 7,594,738 | B1 * | 9/2009 | Lin et al. | 362/249.02 |
| 8,376,583 | B2 * | 2/2013 | Wang et al. | 362/249.05 |
| 8,419,224 | B2 * | 4/2013 | Wan-Chih et al. | 362/294 |

FOREIGN PATENT DOCUMENTS

| | | | |
|---|---|---|---|
| JP | 2007-059156 | A | 3/2007 |
| JP | 4528862 | B1 | 8/2010 |
| KR | 10-2009-0090857 | A | 8/2009 |
| KR | 10-0926772 | B1 | 11/2009 |
| KR | 20-0449849 | Y1 | 8/2010 |
| KR | 10-0985505 | B1 | 10/2010 |
| KR | 10-2011-0007536 | A | 1/2011 |
| KR | 10-2011-0073677 | A | 6/2011 |

OTHER PUBLICATIONS

Korean Notice of Allowance dated Nov. 15, 2012 issued in Application No. 10-2011-0106311 (with English Translation).

* cited by examiner

*Primary Examiner* — Mary Ellen Bowman
(74) *Attorney, Agent, or Firm* — KED & Associates LLP

(57) ABSTRACT

There is disclosed a lighting that has an electronic module capable of repaired and replaced easily and efficiently and that can prevent foreign substances from being drawn therein, with enhanced spatial utilization.

16 Claims, 7 Drawing Sheets

(a)

(b)

(a)

(b)

LIGHTING APPARATUS

CROSS REFERENCE TO RELATED APPLICATION

This application claims the benefit of the Patent Korean Application No. 10-2011-0106311, filed on Oct. 18, 2011, which is hereby incorporated by reference as if fully set forth herein.

BACKGROUND OF THE DISCLOSURE

1. Field of the Disclosure

The present invention relates to a lighting apparatus, more particularly, to a lighting apparatus that has an electronic module capable of being repaired and replaced easily and efficiently and that can prevent foreign substances from being drawn therein, with enhanced spatial utilization.

2. Discussion of the Related Art

Generally, the lighting industry has a long history which is as old as civilization and it is closely related with human beings.

The lighting industry has been under sustainable development and various studies on light sources, a light-emitting method, a driving module and lighting efficiency improvement have been made.

A light source usually used in a lighting apparatus may be an incandescent lamp, an electric-discharge lamp and a fluorescent lamp and such a light source is used for various purposes such as for domestic usage, landscape usage and industrial usage.

The incandescent lamp which is a resistive light source has disadvantages of deteriorated light-emitting efficiency and a generated heat. The electric-discharge lamp has disadvantages of a high price and a high voltage. The fluorescent lamp has an environmental disadvantage of mercury usage.

To solve those disadvantages of such the light sources, interests in light emitting diodes (LED) have been increasing because they have advantages of high light emitting efficiency, a variety of colors and designable freedom.

Such a light emitting diode (LED) is a semiconductor element which emits a light when a voltage is applied to the light emitting diode forwardly. The light emitting diode has a long life span of usage, low power consumption. In addition, it has electrical, optical and physical properties which are proper to mass production. Because of that, the light emitting diodes (LED) have been substituting for the incandescent lamps and fluorescent lamps rapidly.

Meanwhile, a lighting apparatus having the light emitting diode mounted therein may be classified into a flat type fixed to the ceiling to light a broad space such as an office and a bulb type.

In this instance, the flat plate type lighting apparatus includes a flat-plate shaped housing configured to define an exterior appearance thereof, a substrate arranged in the housing, a light emitting diode mounted on the substrate and an electronic module configured to provide an electric power to the light emitting diode.

Typically, the flat type lighting apparatus is installed to the ceiling. Because of that characteristic, the electronic module provided in the lighting apparatus is arranged in the ceiling, not exposed outside. Accordingly, it is difficult for a user to access the electronic module.

As a result, when the electronic module needs replacing or repairing, the entire lighting apparatus has to be separated from the ceiling inconveniently. When the electronic module is out of order, it is difficult to replace only the electronic module and a new lighting apparatus has to be installed disadvantageously.

SUMMARY OF THE DISCLOSURE

Accordingly, the invention is directed to a lighting apparatus. An object of the invention is to provide a lighting apparatus that has an electronic module repaired and replaced easily and efficiently Another object of the invention is to provide a lighting apparatus that can prevent foreign substances from being drawn therein, with enhanced spatial utilization.

Additional advantages, objects, and features of the disclosure will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings. To achieve these objects and other advantages and in accordance with the purpose of the invention, as embodied and broadly described herein, a lighting apparatus includes a front frame; a rear frame coupled to the front frame, with a through hole formed therein; a light emitting module arranged between the front frame and the rear frame, the light emitting module comprising a substrate and an LED mounted on the substrate; and an electronic module detachably mounted to a rear surface of the rear frame, with being electrically connected with the light emitting module via the through hole. The electronic module may be withdrawable forwardly with respect to the rear frame.

The lighting apparatus may further include a cap detachably coupled to the through hole to selectively open and close the through hole and a cable connecting the light emitting module and the electronic module with each other may pass through the cap.

The lighting apparatus may further include an auxiliary light emitting module arranged between the front frame and the rear frame to be overlapped with the through hole, the auxiliary light emitting module including an auxiliary substrate detachably mounted to the light emitting module or the rear frame and an LED mounted on the auxiliary substrate.

The front frame may be rotatably coupled to the rear frame to open and close the rear frame.

The front frame may be formed of resin and the rear frame is formed of metal.

A hooking part may be provided in the front frame and a hook part may be provided in the rear frame to be supported by the hooking part.

The lighting apparatus may further include a diffusive member arranged between the front frame and the light emitting module.

In another aspect of the invention, a lighting apparatus includes a front frame; a rear frame coupled to the front frame; a light emitting module arranged between the front frame and the rear frame, the light emitting module comprising a substrate and an LED mounted on the substrate; and an electronic module detachably mounted to the rear frame to be arranged between the front frame and the light emitting module, with being electrically connected with the light emitting module via a connection terminal. The electronic module may be withdrawable forwardly with respect to the rear frame, when separated from the connection with the connection terminal.

The electronic module may be partially overlapped with the light emitting module.

The lighting apparatus may further a reflective member provided in an outer circumferential surface of the electronic module.

A plurality of heat radiation fins may be provided in the electronic module and the plurality of the heat radiation fins are in contact with the rear frame.

The front frame may be rotatably coupled to the rear frame to open and close the rear frame.

The front frame may be formed of resin and the rear frame is formed of metal.

A hooking part is provided in the front frame and a hook part is provided in the rear frame to be supported by the hooking part.

The hooking part may have two or more bent portions.

The lighting apparatus may further include a diffusive member arranged between the front frame and the light emitting module.

As described above, the lighting apparatus according to this embodiment may have the electronic module that can be easy and smooth to replace and repair and that can prevent foreign matters from being drawn therein, with enhance the spatial utilization.

BRIEF DESCRIPTION OF THE DRAWINGS

The accompanying drawings, which are included to provide a further understanding of the disclosure and are incorporated in and constitute a part of this application, illustrate embodiment(s) of the disclosure and together with the description serve to explain the principle of the disclosure. In the drawings.

DESCRIPTION OF SPECIFIC EMBODIMENTS

A lighting apparatus according to a first embodiment of the present invention will be described in detail in reference to the accompanying drawings as follows. The accompanying drawings are illustrated to describe examples of the present invention and they are provided explain the present invention more specifically, as the present invention is not limited thereto.

Reference will now be made in detail to the specific embodiments of the present invention, examples of which are illustrated in the accompanying drawings. Wherever possible, the same reference numbers will be used throughout the drawings to refer to the same or like parts. Repeated description will be omitted and the size and appearance of each part illustrated for explanation convenience may be exaggerated or minimized.

Meanwhile, terminology including ordinal numbers like 'first' and 'second' may be used to explain various parts of the present invention and the various parts are not limited by the terminology. The terminology is used only to distinguish one of the parts from the others.

Figure 1:
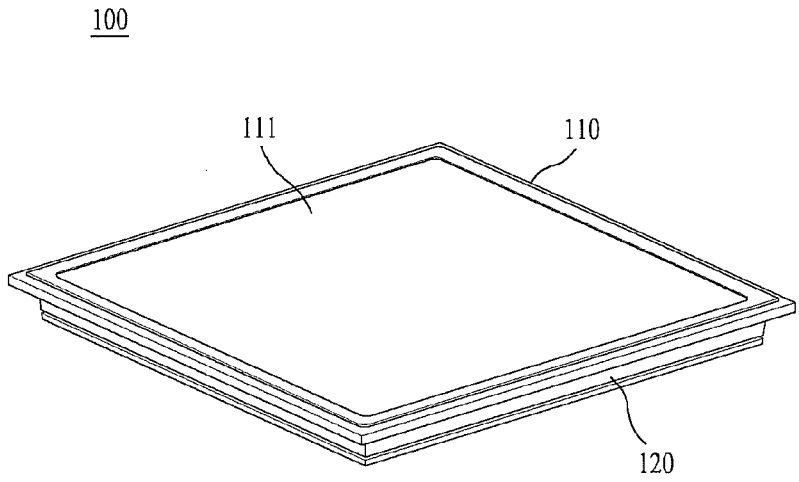
FIG. 1 is a perspective view illustrating a lighting apparatus according to an embodiment of the invention.
Figure 2:
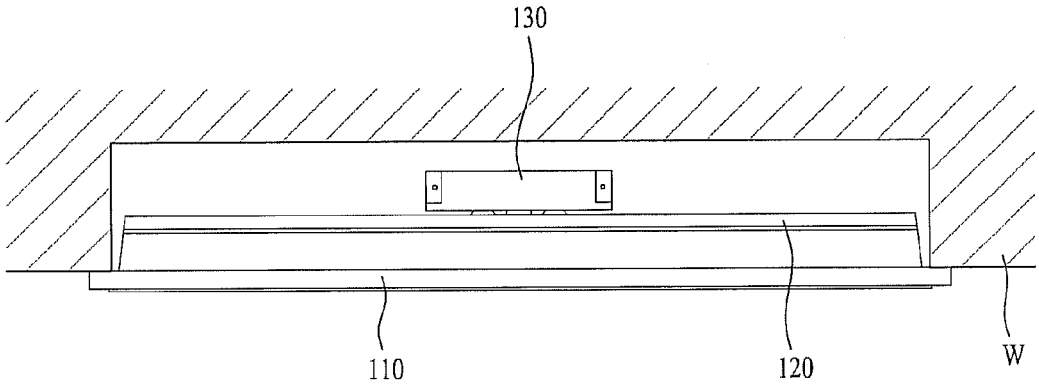
FIG. 2 is a conceptual diagram to explain an installation state of the lighting apparatus shown in FIG. 1.
Figure 3:
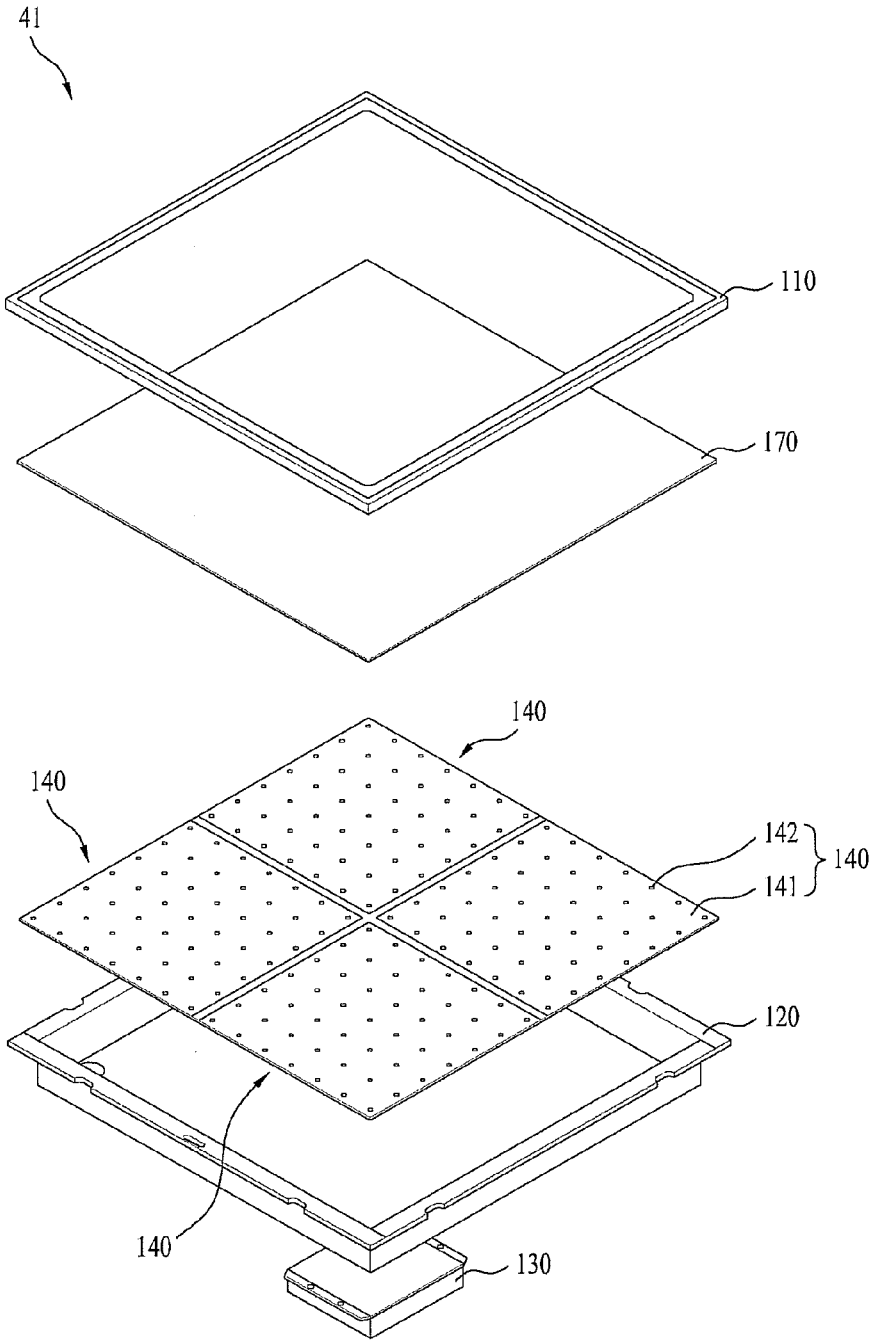
FIG. 3 is an exploded perspective view illustrating the lighting apparatus according to the embodiment of the invention.

FIG. 1 is a side view illustrating a lighting apparatus according to a first embodiment of the invention. FIG. 2 is a conceptual diagram to explain an installation state of the lighting apparatus shown in FIG. 1. FIG. 3 is an exploded perspective view illustrating the lighting apparatus according to the embodiment of the invention.

Figure 4:
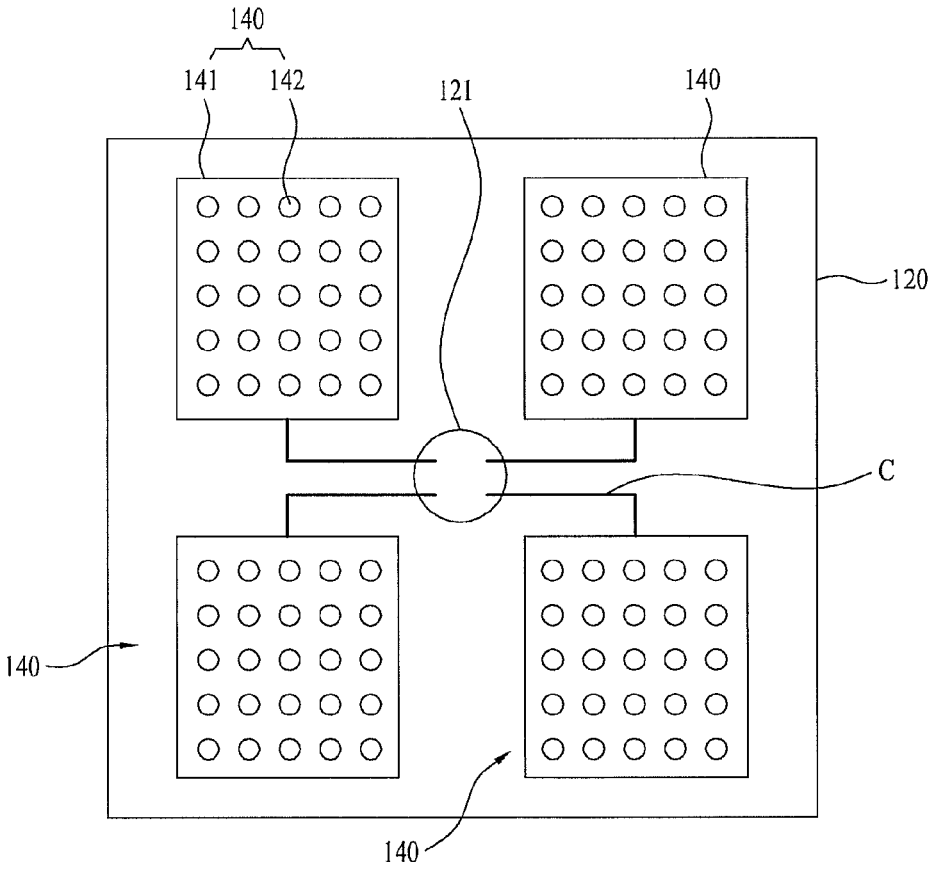
FIG. 4 is a front view illustrating an open state of a front frame provided in the lighting apparatus according to the embodiment of the invention.
Figure 5:
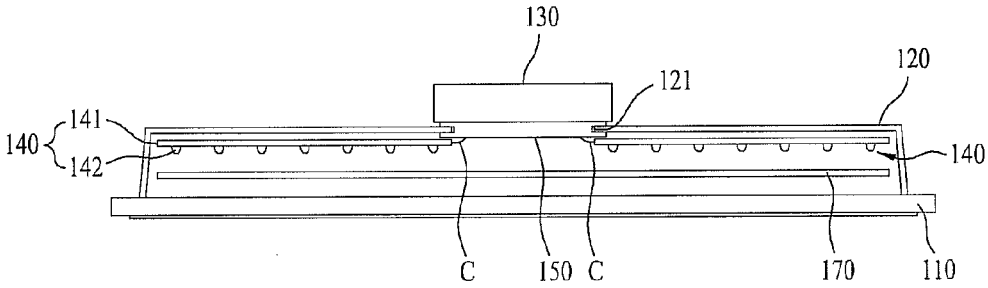
FIG. 5 is a conceptual diagram to explain a replacing process of an electronic module provided in the lighting apparatus according to the invention.

Also, FIG. 4 is a front view illustrating an open state of a front frame provided in the lighting apparatus according to the embodiment of the invention. FIG. 5 is a conceptual diagram to explain a replacing process of an electronic module provided in the lighting apparatus according to the invention.

The lighting apparatus 100 according to the embodiment of the invention includes a front frame 110, a rear frame 120 coupled to the front frame 110, with a through hole 121 formed therein, a light emitting module 140 arranged between the front frame 110 and the rear frame 120, with a substrate 141 and an LED 142 mounted on the substrate 141, and an electronic module 130 detachably mounted to a rear surface of the rear frame 120, with being electrically connected with the light emitting module.

The front frame 110 may define an exterior appearance of the lighting apparatus 100 and it may have various appearances, considering a design characteristic. Also, the front frame 110 includes a light transmission part 111 configured to emit the light irradiated from the light emitting module 140 toward a lighting room.

To make the lighting apparatus 100 lighter and compact-sized and to enhance the heat radiation of the lighting apparatus 100, the front frame 110 may be formed of resin and the rear frame 120 may be formed of metal.

The light emitting module 140 may be positioned in front of the rear frame 120, in connection with the rear frame 120. Also, a plurality of light emitting modules 140 may be provided in the rear frame 120 according to the required quantity of lights.

In addition, the light emitting module may be electrically connected with the electronic module 130 via a cable (C) and the cable (C) may electrically connect the light emitting module 140 on a front surface of the rear frame with the electronic module 130 arranged on a back surface of the rear frame, after passing the through hole 121.

Also, the lighting apparatus 100 may further include a diffusive member 170 arranged between the light emitting module 140 and the front frame 110.

The electric component 130 may be detachably mounted on the back surface of the rear frame 120.

Meanwhile, the meaning of the being detachable is not only that the electronic module 130 can be detached from the rear frame 120 by a predetermined force applied to the electronic module 130, when the control unit 130 is hookedly coupled to the rear frame 120 without an auxiliary coupling member, but also that a coupling member is separated via the front surface of the rear frame 120 when the electronic module 130 is coupled or connected by a coupling member, to detach the electronic module from the rear frame 120.

Meanwhile, in reference to FIG. 2, the lighting apparatus 100 may be installed, with the front frame 110 exposed to a wall (W) such as a ceiling. The electronic module 130 may be arranged in the wall (W), with being fixed to the rear frame.

In this instance, the rear frame 120 may have the through hole 121 and the through hole 121 may have a predetermined size allowing the electronic module 130 to pass there through.

Figure 7:
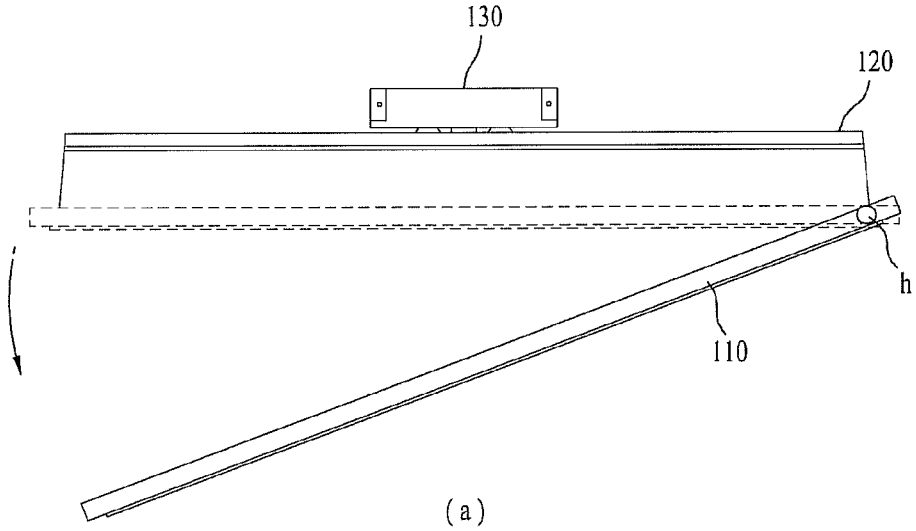
Figure 7:
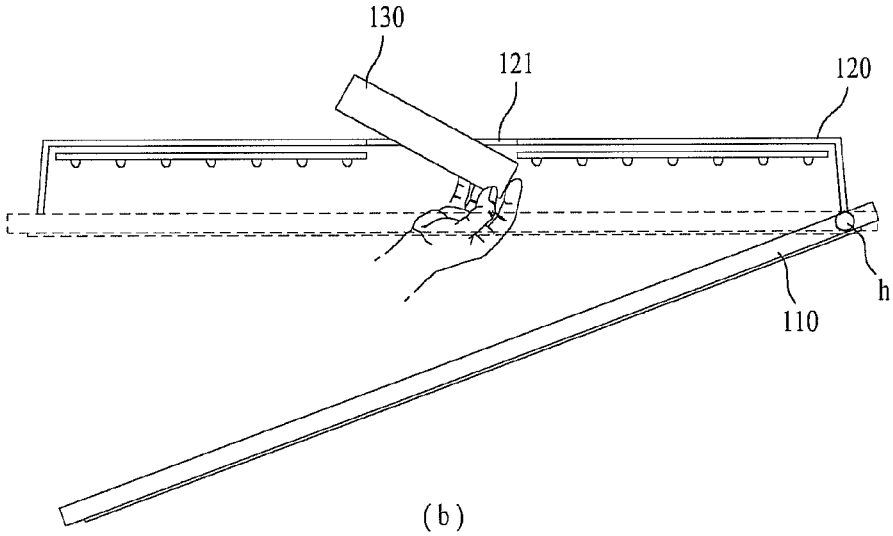

In reference to FIG. 7, the electronic module 130 may be retractable via the through hole 121, to be in front of the rear frame 120.

Meanwhile, the front frame 110 may be rotatably coupled to the rear frame 120 to open and close the rear frame 120, to move the electronic module 130 forwardly via the through hole 121.

For example, the front frame 110 may be connected to the rear frame 120 by a hinge (h).

As a result, to replace or repair the electronic module 130, the user may rotate the front frame 110 and open a predetermined area or more of the front surface of the rear frame 120, and the user may then withdraw the electronic module 130 in front of the rear frame 120 via the through hole 121.

Meanwhile, it is described that the rear frame 120 is opened with the front frame 110 rotatably coupled thereto. however, the embodiment of the invention may not be limited thereto. alternatively, the front frame 110 may be detachably fixed to the rear frame 120 in various ways.

Figure 6:
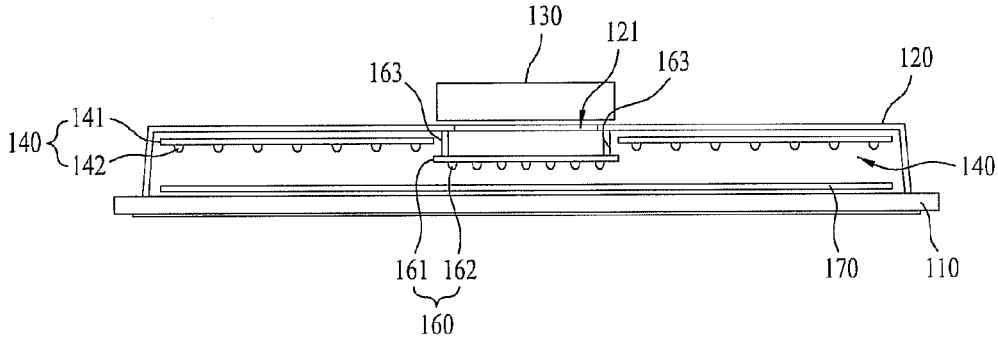
FIGS. 6 and 7 are conceptual diagrams to explain various embodiments of the lighting apparatus according to the invention.

FIGS. 6 and 7 are conceptual diagrams to explain various embodiments of the lighting apparatus according to the invention.

In reference to FIG. 6, the through hole 121 may have the predetermined size allowing the electronic module 130 to pass there through and foreign matters might be drawn into the lighting apparatus 100 via such the through hole 121.

The lighting apparatus 100 according to the embodiment of the invention may further include a cap 150 detachably coupled to the through hole 121 to selectively open and close the through hole 121.

Also, the cable (C) connecting the light emitting module 140 with the electronic module 130 may pass through the cap 150.

The cap 150 may be formed of a predetermined material such as robber and it may be in close contact with an inner circumferential surface of the through hole 121 to prevent the foreign matters from being drawn via the through hole 121. The user may detach the cap 150 from the through hole 121 and withdraw the electronic module 130 forwardly with respect to the rear frame 120.

In reference to FIG. 7, the light emitting module 140 may be arranged in a radial direction with respect to the through hole 121. The region of the through hole 121 may be an invalid space in a view of part arrangement.

In reference to FIG. 7, the lighting apparatus 100 according to the embodiment of the invention may further include an auxiliary light emitting module 160 having an auxiliary substrate 161 arranged a space formed between the front frame 110 and the rear frame 120 to be overlapped with the through hole 121 and a LED 162 mounted on the auxiliary substrate 161.

The auxiliary light emitting module 160 may increase the quantity of the lights emitted from the lighting apparatus 100 and it may reduce an invalid space within the lighting apparatus 100, only to enhance spatial utilization.

Also, the auxiliary light emitting module 160 may be detachably mounted to the light emitting module 140 or the rear frame 120 by at least one supporting member 163. FIG. 7 shows the auxiliary light emitting module 160 detachably mounted to the rear frame 120 and the embodiment of the invention may not be limited thereto. The auxiliary light emitting module 160 may be detachably mounted to one of the light emitting module 130 and the rear frame 120.

In this instance, the user detach the auxiliary light emitting module 160 from the rear frame 120 or the light emitting module 140, and the user may then the electronic module 130 forwardly to be in front of the rear frame 120.

Figure 8:
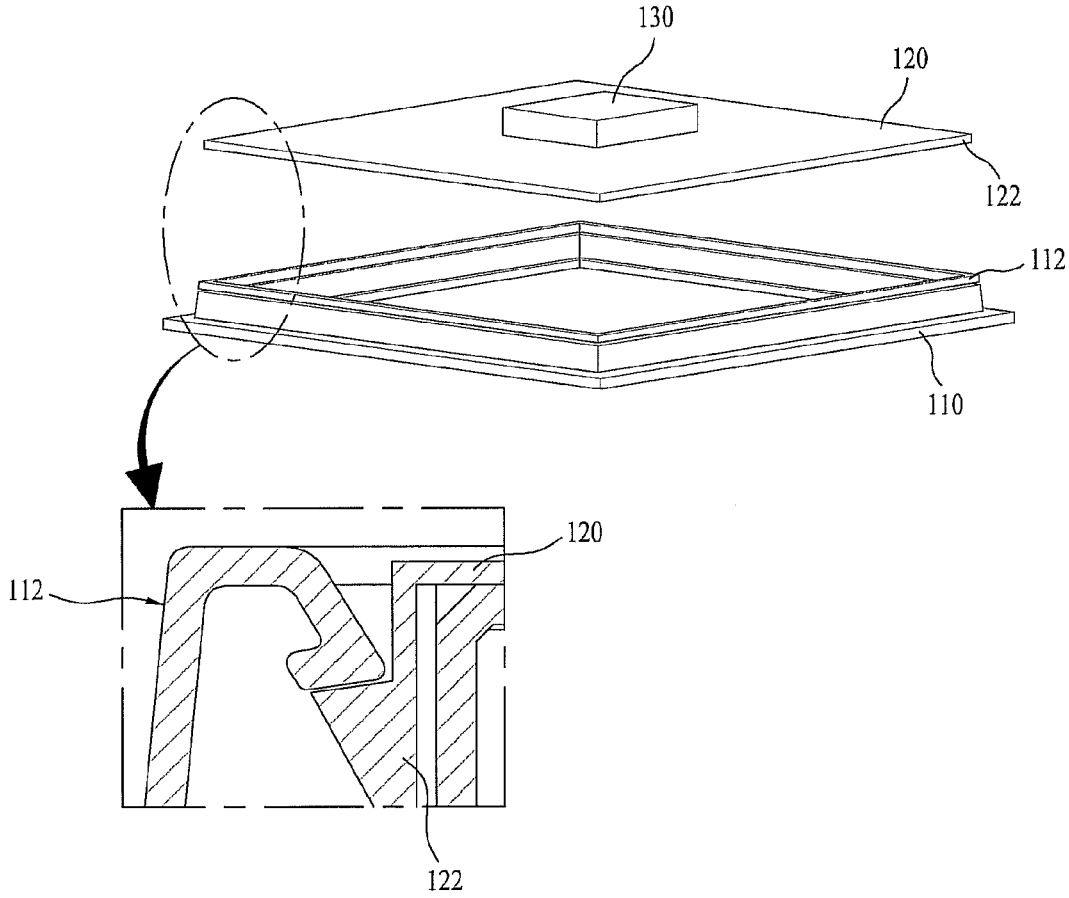
FIG. 8 is an exploded perspective view illustrating a coupling state between the front frame and a rear frame composing the lighting apparatus according to the invention.

FIG. 8 is an exploded perspective view to explain the coupling relation between the front frame and the rear frame provided in the lighting apparatus according to the invention.

Different from FIG. 5, FIG. 8 shows that a hooking part 112 provided in the front frame 110 and a hook part 122 hooked by the hooking part 112 is provided in the rear frame 120.

The hooking part 112 and the hook part 122 may be supported to each other by the shapes thereof. For example, the hooking part 112 may have two or more bent portions. In this instance, to make the lighting apparatus 100 lighter and compacted-sized and to enhance the heat radiation characteristic of the lighting apparatus 100 as mentioned above, the front frame 110 may be formed of resin and the rear frame 120 may be formed of metal.

Also, even when an end of the front frame 100 is rotatably coupled to the rear frame 120, the other end of the front frame 100 may be coupled to the hooking part 112 and the hook part 122 of the rear frame 120.

Figure 9:
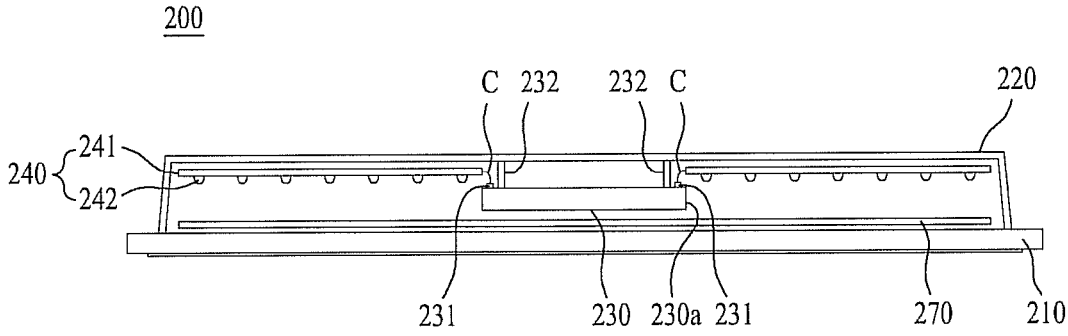
FIG. 9 is a conceptual diagram illustrating a lighting apparatus according to another embodiment of the invention.

FIG. 9 is a conceptual diagram illustrating a lighting apparatus according to another embodiment of the invention.

The lighting apparatus 200 according to another embodiment of the invention includes a front frame 210, a rear frame 220 coupled to the front frame 210, a light emitting module 240 arranged between the front frame and the rear frame, with a substrate 241 and an LED 242 mounted on the substrate 241, and an electronic module 230 detachably mounted to the rear frame 220 to be arranged between the front frame 210 and the light emitting module 240, with being electrically connected with the light emitting module 240 via a connection terminal 231.

In this instance, the electronic module 240 may be withdrawable forwardly to be in front of the rear frame 220, when it is detached from the rear frame 220 and the connection terminal 231.

The lighting apparatus 200 according to this embodiment of the invention has the difference that the electronic module 230 is arranged between the front frame 210 and the rear frame 220. There may be no through hole formed in the rear frame because of the difference.

The coupling structure of the front frame 210 and the rear frame 220 is identical to that of the embodiment mentioned above and detained description thereof will be omitted accordingly. The difference will be described in detail as follows.

The electronic module 230 may be partially overlapped with the light emitting module and the lighting apparatus 200 may further include a reflective member 231 provided in an outer circumferential surface of the electronic module 230. Accordingly, degrading of luminous efficiency may be prevented even when the electronic module 230 is partially overlapped with the light emitting module.

Also, a plurality of heat-radiation fins may be provided in the electronic module 230 to enhance a heat radiation characteristic of the electronic module 230. The heat radiation fins 232 may be in contact with the rear frame 220. Also, the heat radiation fins 232 may detachably connect the electronic module 230 with the rear frame 220.

The connection terminal 231 may be connected with a cable (C) connected with the light emitting module 240.

As mentioned above, the front frame 210 may be rotatably coupled to the rear frame 220 to open and close the rear frame 220. The front frame 210 may be formed of resin and the rear frame 220 may be formed of metal. Also, a hooking part may be provided in the front frame 210 and a hook part supported by the hooking part may be provided in the rear frame 220.

The user may open a front surface of the rear frame 220 by detaching or rotating the front frame 210 and separate the cable (C) from the connection terminal 231. After that, the user may withdraw the electric component unit 230 forwardly with respect to the rear frame 220.

Also, the lighting apparatus 200 may further include a diffusive member 270 arranged between the front frame 210 and the light emitting module 240.

As described above, the lighting apparatus according to this embodiment may have the electronic module that can be easy and smooth to replace and repair and that can prevent foreign matters from being drawn therein, with enhance the spatial utilization.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A lighting apparatus comprising:

a front frame;

a rear frame coupled to the front frame, with a through hole formed therein;

a light emitting module arranged between the front frame and the rear frame, the light emitting module comprising a substrate and an LED mounted on the substrate; and an electronic module detachably mounted to a rear surface of the rear frame, with being electrically connected with the light emitting module via the through hole, wherein the electronic module is withdrawable forwardly with respect to the rear frame.

2. The lighting apparatus according to claim 1, further comprising a cap detachably coupled to the through hole to selectively open and close the through hole, wherein a cable connecting the light emitting module and the electronic module with each other passes through the cap.

3. The lighting apparatus according to claim 1, further comprising:

an auxiliary light emitting module arranged between the front frame and the rear frame to be overlapped with the through hole, the auxiliary light emitting module comprising an auxiliary substrate detachably mounted to the light emitting module or the rear frame and an LED mounted on the auxiliary substrate.

4. The lighting apparatus according to claim 1, wherein the front frame is rotatably coupled to the rear frame to open and close the rear frame.

5. The lighting apparatus according to claim 1, wherein the front frame is formed of resin and the rear frame is formed of metal.

6. The lighting apparatus according to claim 5, wherein a hooking part is provided in the front frame and a hook part is provided in the rear frame to be supported by the hooking part.

7. The lighting apparatus according to claim 1, further comprising:

a diffusive member arranged between the front frame and the light emitting module.

8. A lighting apparatus comprising:

a front frame;

a rear frame coupled to the front frame;

a light emitting module arranged between the front frame and the rear frame, the light emitting module comprising a substrate and an LED mounted on the substrate; and an electronic module detachably mounted to the rear frame to be arranged between the front frame and the light emitting module, with being electrically connected with the light emitting module via a connection terminal, wherein the electronic module is withdrawable forwardly with respect to the rear frame, when separated from the connection with the connection terminal.

9. The lighting apparatus according to claim 8, wherein the electronic module is partially overlapped with the light emitting module.

10. The lighting apparatus according to claim 8, further comprising:

a reflective member provided in an outer circumferential surface of the electronic module.

11. The lighting apparatus according to claim 8, wherein a plurality of heat radiation fins are provided in the electronic module and the plurality of the heat radiation fins are in contact with the rear frame.

12. The lighting apparatus according to claim 8, wherein the front frame is rotatably coupled to the rear frame to open and close the rear frame.

13. The lighting apparatus according to claim 8, wherein the front frame is formed of resin and the rear frame is formed of metal.

14. The lighting apparatus according to claim 13, wherein a hooking part is provided in the front frame and a hook part is provided in the rear frame to be supported by the hooking part.

15. The lighting apparatus according to claim 14, wherein the hooking part comprises two or more bent portions.

16. The lighting apparatus according to claim 8, further comprising:

a diffusive member arranged between the front frame and the light emitting module.

* * * * *